US007516793B2

(12) United States Patent
Dykstra

(10) Patent No.: US 7,516,793 B2
(45) Date of Patent: Apr. 14, 2009

(54) METHODS AND SYSTEMS FOR FRACTURING SUBTERRANEAN WELLS

(75) Inventor: Jason D. Dykstra, Addison, TX (US)

(73) Assignee: Halliburton Energy Service, Inc., Duncan, OK (US)

( * ) Notice: Subject to any disclaimer, the term of this patent is extended or adjusted under 35 U.S.C. 154(b) by 91 days.

(21) Appl. No.: 11/651,913

(22) Filed: Jan. 10, 2007

(65) Prior Publication Data

US 2008/0164021 A1 Jul. 10, 2008

(51) Int. Cl.
*E21B 43/26* (2006.01)
*E21B 47/00* (2006.01)

(52) U.S. Cl. ..... 166/308.1; 166/177.5; 166/250.1

(58) Field of Classification Search ..... None
See application file for complete search history.

(56) References Cited

U.S. PATENT DOCUMENTS

| | | | | |
|---|---|---|---|---|
| 5,353,637 | A * | 10/1994 | Plumb et al. | 73/152.17 |
| 6,719,055 | B2 | 4/2004 | Mese et al. | |
| 6,876,959 | B1 | 4/2005 | Peirce et al. | |
| 6,935,424 | B2 | 8/2005 | Lehman et al. | |
| 6,938,690 | B2 | 9/2005 | Surjaatmadja | |
| 6,959,773 | B2 | 11/2005 | Mese et al. | |
| 6,978,831 | B2 | 12/2005 | Nguyen | |
| 2005/0125209 | A1 | 6/2005 | Soliman et al. | |

OTHER PUBLICATIONS

SPE XP-002472183 "Enhancement of Real-Time Hydraulic Fracturing Models with Full 3-D Simulation" By M.P. Cleary.

Foreign communication related to a counterpart application dated Mar. 27, 2008.

Saputelli et al. Real-Time Decision-making for Value Creation While Drilling; SPE/IADC 85314, 2003.

Iversen et al. Monitoring and Control of Drilling Utilizing Continuously Updated Process Models; IADC/SPE 99207, Feb. 2006.

Yew, Ching H. "Mechanics of Hydraulic Fracturing", 1997, Gulf Publishing Company, Houston, Texas, Chpt 1 pp. 1-29.

Gidley et al. "Recent Advances in Hydraulic Fracturing", 1989, Society of Petroleum Engineers Monograph Series, Richardson, TX Cht 5 pp. 95-108.

Tilt Fracture Mapping 2006 Pinnacle Technologies, Inc.

* cited by examiner

*Primary Examiner*—Zakiya W. Bates
(74) *Attorney, Agent, or Firm*—John W. Wustenberg; Groover & Associates

(57) ABSTRACT

New methods and systems for subterranean fracturing for hydrocarbon wells. A plan of the fracture propagation and in-fracture proppant distribution is used with a real-time model of the status of the fracture dimensions and in-fracture proppant concentration to automatically control flow rates and properties of a fracturing fluid flow stream being used to induce and prop the fracture. Real-time measurements of the status of the fracture are made using surface and/or downhole sensors. Real-time control over the flow rate and properties of a fracturing fluid flow stream are made by manipulating the fracturing fluid supply equipment. Real-time modifications of the fracturing model are made by comparing fracture sensor measurements of actual fracture dimensions to the predicted dimensions, and then adjusting the model for inaccuracies. Real-time updates to the fracturing plan are made by comparing actual fracture and propping results to desired results, and then adjusting to achieve optimal results.

18 Claims, 8 Drawing Sheets

PRIOR ART

PRIOR ART

End View of Fracture

PRIOR ART

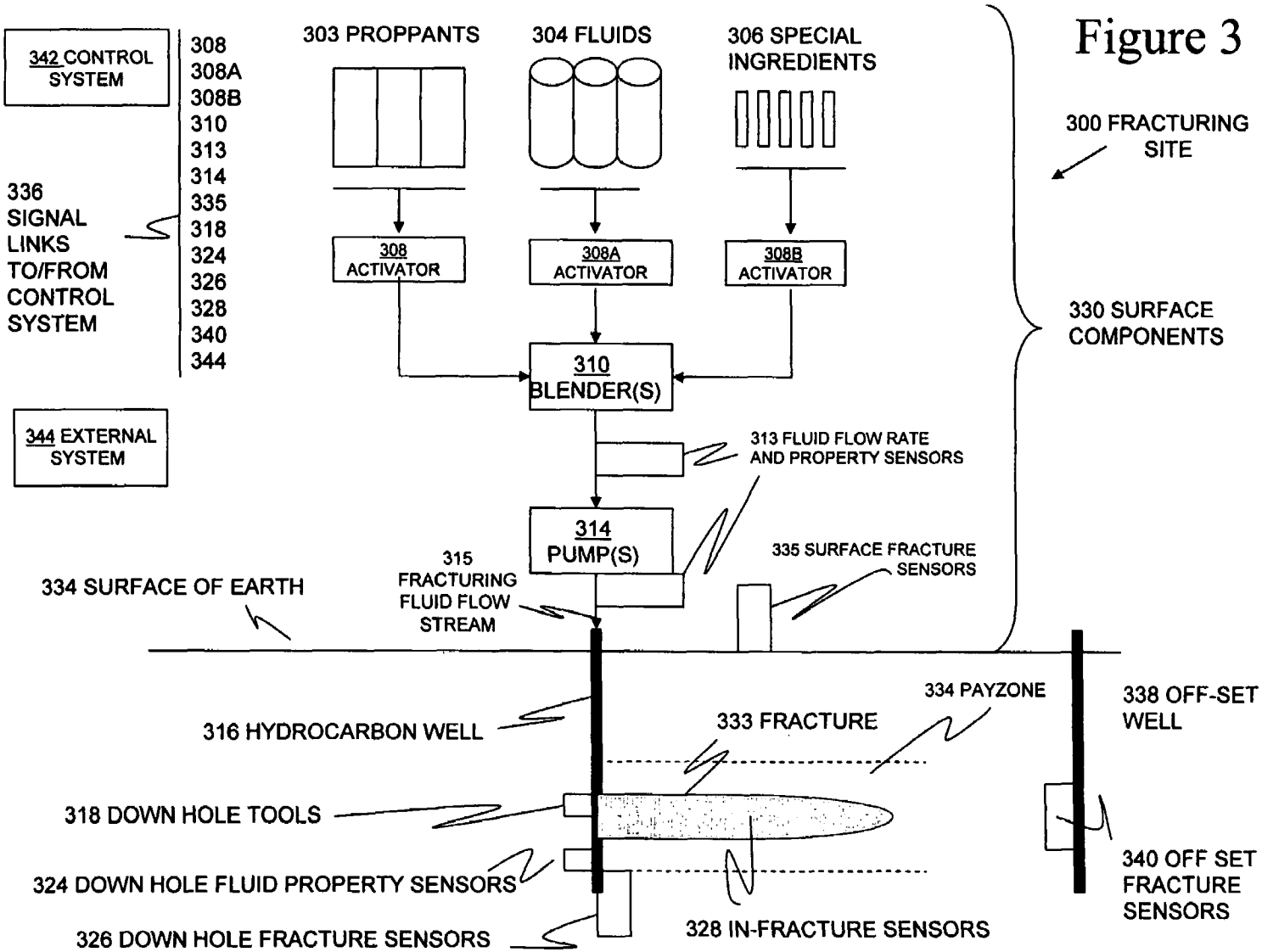
Figure 3
300 FRACTURING SITE
330 SURFACE COMPONENTS
303 PROPPANTS
304 FLUIDS
306 SPECIAL INGREDIENTS
308 ACTIVATOR
308A ACTIVATOR
308B ACTIVATOR
310 BLENDER(S)
313 FLUID FLOW RATE AND PROPERTY SENSORS
314 PUMP(S)
315 FRACTURING FLUID FLOW STREAM
335 SURFACE FRACTURE SENSORS
334 SURFACE OF EARTH
316 HYDROCARBON WELL
333 FRACTURE
334 PAYZONE
338 OFF-SET WELL
340 OFF SET FRACTURE SENSORS
318 DOWN HOLE TOOLS
324 DOWN HOLE FLUID PROPERTY SENSORS
326 DOWN HOLE FRACTURE SENSORS
328 IN-FRACTURE SENSORS
342 CONTROL SYSTEM
344 EXTERNAL SYSTEM
336 SIGNAL LINKS TO/FROM CONTROL SYSTEM
308
308A
308B
310
313
314
335
318
324
326
328
340
344

METHODS AND SYSTEMS FOR FRACTURING SUBTERRANEAN WELLS

BACKGROUND AND SUMMARY OF THE INVENTION

The present application relates to methods and systems for conducting the hydraulic fracturing of subterranean wells, and more particularly to the control of processes related to subterranean hydraulic fracturing used to stimulate the production of hydrocarbon wells, and most especially to real-time and automatic control of fracture propagation and placement of proppant therein.

The following paragraphs contain some discussion, which is illuminated by the innovations disclosed in this application, and any discussion of actual or proposed or possible approaches in these paragraphs does not imply that those approaches are prior art.

Background: Hydrocarbon Formation Fracturing and Propping

Subterranean hydraulic fracturing is conducted to increase or "stimulate" production from a hydrocarbon well. To conduct a fracturing process, high pressure is used to pump special fracturing fluids, including some that contain propping agents ("proppants") down-hole and into a hydrocarbon formation to split or "fracture" the rock formation along veins or planes extending from the well-bore. Once the desired fracture is formed, the fluid flow is reversed and the liquid portion of the fracturing fluid is removed. The proppants are intentionally left behind to stop the fracture from closing onto itself due to the weight and stresses within the formation. The proppants thus literally "prop-apart", or support the fracture to stay open, yet remain highly permeable to hydrocarbon fluid flow since they form a packed bed of particles with interstitial void space connectivity. Sand is one example of a commonly-used proppant. The newly-created-and-propped fracture or fractures can thus serve as new formation drainage area and new flow conduits from the formation to the well, providing for an increased fluid flow rate, and hence increased production, of hydrocarbons.

To plan a fracture's height, length, and width, many factors are considered, including the characteristics of the producing formation to be fractured, such as its size and geometry, its mechanical properties, its permeability to fluid flow, and any near-by water-bearing formations. In general, an optimum result of a fracture includes balancing the width, length, and height of the fracture with the fluid permeability of the formation and fluid conductivity of the propped fracture.

To plan a fracturing fluid pumping process to create a targeted fracture, fracturing models can be used which predict the propagation of fractures through a formation of given mechanical properties in relation the pumped volume, pumping rate, and rheologic properties of the fracturing fluid being used. Two-dimensional models such as the Khristianovic-Geertsma-de-Klerk model and the Perkins-Kern-Nordgren model are well-known to those skilled in the art of fracturing. See Chapter 1 of "Mechanics of Hydraulic Fracturing" by Ching H. Yew, 1997, by Gulf Publishing Company, Houston, Tex., ISBN 0-88415-474-2, which is hereby incorporated by reference. Three dimensional fracturing planning models are also well-known to those skilled in the art of fracturing. See Chapter 5 of "Recent Advances in Hydraulic Fracturing" by John L. Gidley, Stephen A. Holditch, Dale E. Nierode, and Ralph W. Veatch Jr., Society of Petroleum Engineers Monograph Series, Richardson, Tex., 1989.

To begin a fracturing process, at least one perforation is made at a particular down-hole location through the wall of the well casing to provide access to the formation for the fracturing fluid. Perforation technologies are well known to those skilled in the art of hydrocarbon well technology. The direction of the perforation attempts to determine at least the initial direction of the fracture.

A first "mini-fracture" test is usually conducted in which a relatively small amount of proppant-free fracturing fluid is pumped into the formation to determine and/or confirm at least some of the properties of the formation, including the permeability of the formation itself. Accurately knowing the permeability allows for a prediction of the fluid leak-off rate at various pressures, whereby the amount of fracturing fluid that will flow into the formation can be considered in establishing a pumping and proppant schedule. Thus, the total amount of fluid to be pumped down-hole is at least the sum of the hold-up of the well, the amount of fluid that fills the fracture, and the amount of fluid that leaks-off into the formation during the fracturing process itself. Leak-off rate is an important parameter because once proppant-laden fluid is pumped into the fracture, leak-off can increase the concentration of the proppant in the fracturing fluid beyond a target level. Data from the mini-fracture test then is usually used by experts, either on-site or communicating from a distance, to confirm or modify the original desired target profile of the fracture and the process used to achieve the fracture. U.S. patent application Ser. No. 11/031,874, to Mohamed Soliman and David Adams, entitled "Method and System for Determining Formation Properties Based on Fracture Treatment", published on Jul. 13, 2006, teaches mini-fracture technology, and is hereby incorporated by reference.

Fracturing then begins in earnest by first pumping proppant-free fluid into the well-bore or through tubing. The fracture is initiated and begins to grow in height, length, and/or width. This first proppant-free stage is usually called the "pre-pad" and consists of a low viscosity fluid. A second fluid pumping stage is usually then conducted of a different viscosity proppant-free fluid called the "pad." At a particular time in the pumping process, the proppant is then added to the fracturing and propping flow stream using a continuous blending process, and is usually gradually stepped-up in proppant concentration. Too high a concentration of proppant can lead to an undesirable and premature "screen-out" in which the solids concentration within the fracture becomes so high that the pumping pressure exceeds the design limits of the system. In essence, the proppant plugs the fracture and stops the fracturing process. The process must sometimes be stopped because in many situations, continuing pumping will damage surface equipment or the well casing itself, e.g. rupturing the well casing. In other situations, the proppant might collect at an obstruction or within a too-narrow of a fracture, resulting in screen-out as well. U.S. Pat. No. 6,935,424, to Lyle V. Lehman and Christopher A. Wright, entitled "Mitigating Risk by Using Fracture Mapping to Alter Formation Fracturing Process", issued on Aug. 30, 2005, teaches aspects of proppant screen-out, and is hereby incorporated by reference.

Another common problem for a fracturing process is that the current resulting fracture is of the wrong geometry, orientation, directional positioning, and/or dimensions, or tending to be of the wrong geometry, orientation, directional positioning, or dimensions. This type of problem can be related to the inconsistency of subterranean geologic formations such as variable rock or soil properties, variable formation dimensions, or the presence of natural faults or fractures. Those skilled in the art of fracturing usually conduct significant pre-fracturing studies such as the mini-fracture test or other investigative techniques. However, a mini-fracture treatment may be insufficiently conducted as to not reach out far enough from the well to detect, for example, a particular change in rock formations and properties. Those conducting fracturing processes can use mapping of the fracture geometry using, for example, tilt-meters. U.S. Pat. No. 6,935,424 also teaches aspects of fracture mapping.

Another problem that can result during fracturing is that even though a fracture with correct geometry is formed, the fracture is not sufficiently propped, or is inconsistently propped. Thus, the fracture can fully or partially re-close once the hydraulic pressure is released. Or, the proppant is so unevenly distributed that it is not consistently held in place by the formation once the hydraulic pressure is released, i.e. the proppant is "unconsolidated." So, once the well begins or resumes hydrocarbon flow after fracturing, the proppant can be swept-out of the fracture and carried back up the well in the hydrocarbon flow stream, and possibly damage or plug equipment.

Thus, successful fracturing includes achieving desired fracture dimensions and a desired proppant distribution within the fracture. Because of the complexity of achieving both of these simultaneously, there is a need for real-time control of both fracture formation and proppant placement during a fracturing process to achieve total desired results. And, because of the rising cost of providing expert labor to conduct fracturing operations, there is a need for an automatic control method and system for conducting fracturing processes. Further, as the value of hydrocarbons continues to rise, there is an increasing need for reduction of risk of undesired results associated with fracturing.

Methods and Systems for Fracturing Subterranean Wells

The present application discloses methods and systems for conducting subterranean fracturing for hydrocarbon wells. Inputs from fracture sensors and/or fracturing fluid flow stream sensors are monitored and used to estimate the progress of the propagation of a subterranean fracture. The progress estimate is exploited in real-time to automatically manipulate surface and/or down-hole physical components providing fracturing and propping fluids to a hydrocarbon well. This can be advantageously implemented using a real-time model of the fracture and the proppant distribution therein to determine the error from the desired fracture dimensions and the error from the desired proppant distribution within the fracture. The errors can be used by control transforms to derive fracturing and proppant fluid set-points to be used to control processing equipment delivering the fluid. Real-time modifications of the fracturing model can be made by comparing fracture sensor measurements of actual fracture dimensions to the predicted dimensions, and then adjusting the model for inaccuracies. Real-time updates to the fracturing plan can be made by comparing actual fracture and propping results to desired results, and then adjusting to achieve optimal results.

In some embodiments (but not necessarily all), the disclosed ideas are used to provide new fracturing and propping control methods and systems by sensing the status of the fracture propagation and automatically controlling the flow rates, compositions, and properties of fracturing and propping fluids.

In some embodiments (but not necessarily all), the disclosed ideas are used to provide new fracturing and propping control methods and systems by modifying the desired fracture dimensions and desired proppant distribution in real time in response to an unforeseen fracturing and/or propping event or events.

The disclosed innovations, in various embodiments provide one or more of at least the following advantages:

- Improved hydrocarbon production from a hydrocarbon well.
- Improved results of subterranean fracturing whereby the resulting fracture dimensions, directional positioning, orientation, and geometry, and the placement of a proppant within the fracture more closely resemble the desired results.
- Improved results when unforeseen events occur during a fracturing and propping process.
- Reduced dependency on human intervention and decision-making during hydrocarbon formation fracturing.

BRIEF DESCRIPTION OF THE DRAWINGS

The disclosed innovations will be described with reference to the accompanying drawings, which show important sample embodiments of the invention and which are incorporated in the specification hereof by reference.

FIG. 3 shows one embodiment of an exemplary subterranean hydrocarbon formation fracturing site, both surface and down-hole, to which the methods and systems of the present innovations can be applied.

DETAILED DESCRIPTION OF THE PREFERRED EMBODIMENTS

The numerous innovative teachings of the present application will be described with particular reference to the presently preferred embodiment (by way of example, and not of limitation).

Figure 2:
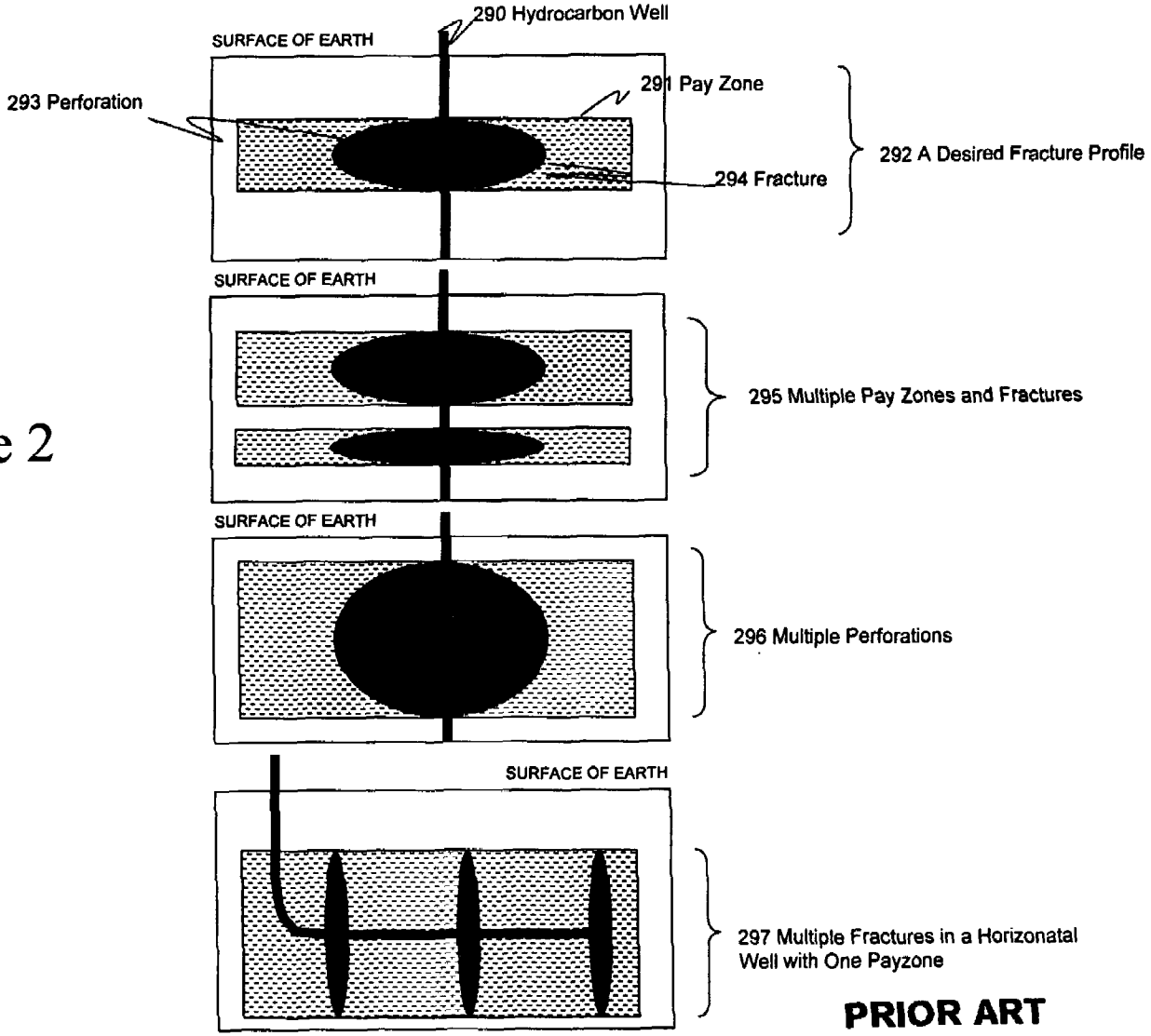
FIG. 2 shows embodiments of desired fractures consistent with desired fracturing profiles of the present innovations.

FIG. 2 shows four embodiments of desired side-view profiles of resulting subterranean fractures, such as can be formed using the methods and systems of the present innovations, by way of examples, and not of limitations. In one embodiment, desired fracture profile 292 shows a side view of a subterranean fracture 294 emanating from perforation 293 in hydrocarbon well 290 that is perfectly contained vertically within pay zone (e.g. hydrocarbon-bearing formation or zone) 291. Any extension beyond the pay zone can be undesirable because no extra hydrocarbon-drainage area is opened-up for production and the fracturing time and fluid was wasted in achieving the non-paying fracture portion. In another embodiment, multiple horizontal pay zones or fractures 295 can be accessed and formed from the same hydrocarbon well with the resulting fractures perfectly vertically contained. In another embodiment 296, two or more perforations, e.g. multiple perforations, can be used to gain increased drainage from a single formation with the resulting formation perfectly contained. In another embodiment in a "horizontal" hydrocarbon well 297, one or more perforations can be used to create multiple fractures in a single formation or pay zone. The fractures shown in 297 are viewed end-wise rather than from a side view.

Figure 2A:
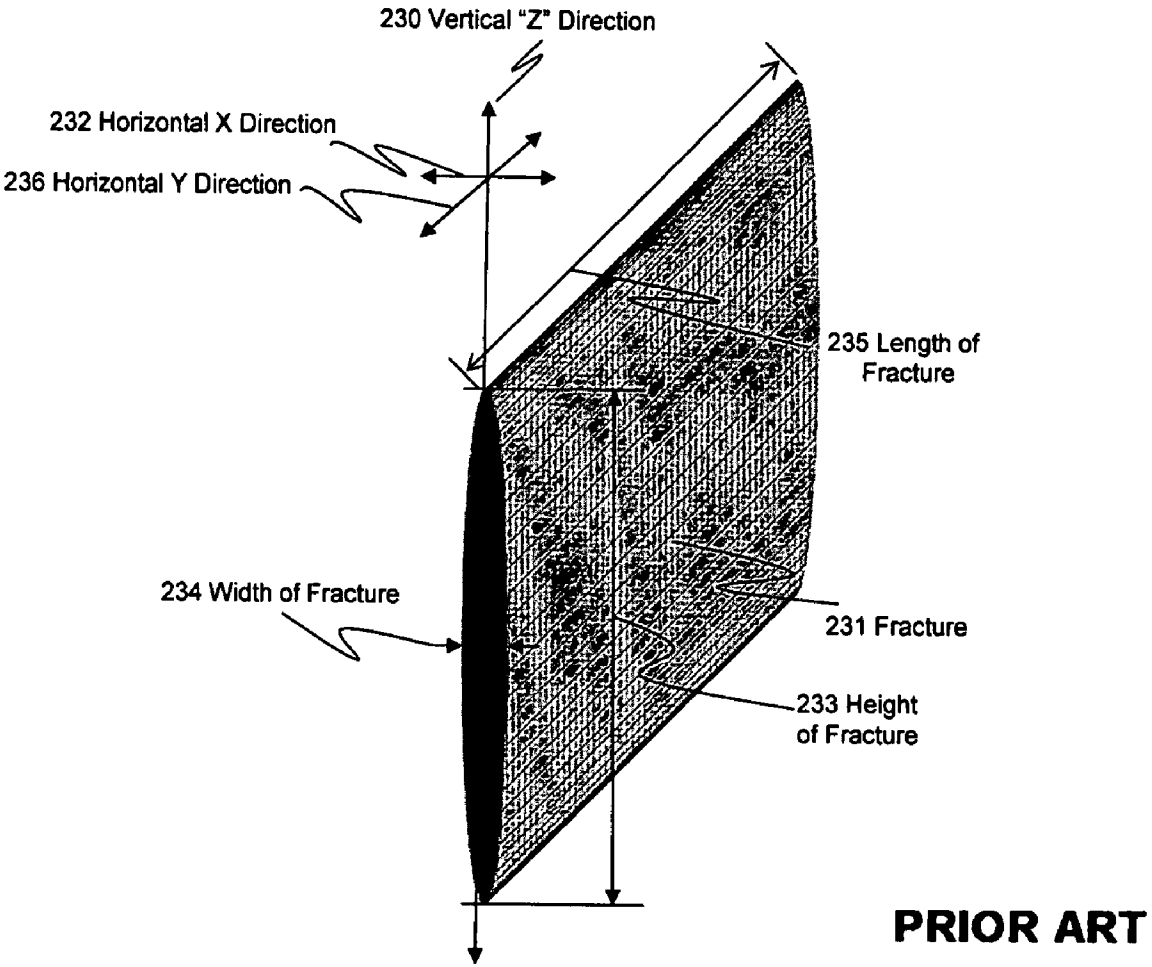
FIG. 2A shows an embodiment of the dimensional, directional positioning, orientation, and geometric attributes of a subterranean fracture.

FIG. 2A shows dimensional, orientation, directional positioning, and geometric attributes of fractures that can be controlled with the present innovations. Fracture 231 is a fracture oriented with its height in the vertical "z" direction 230, with reference to the surface of the earth. Such vertical orientation is the usual orientation resulting during a fracturing process. In another embodiment, fracture 231 can be oriented horizontally, such that its width 234 is in the vertical direction 230 with its length 235 along the "x" horizontal direction 232 or "y" horizontal direction 236 In another embodiment, fracture 231 can be tilted and not in-line with the orthogonal axes depicted in FIG. 2A. Width of fracture 234 is the smallest dimension of fracture 231, and usually on the order of magnitude of a fractions of a inch or inches. Length of fracture 235 is the dimension of growth generally away from the well. In one embodiment as shown of fracture 231, a desired fracture can have a generally constant height such that the height runs parallel to the top, and bottom, of a pay zone as shown in fracture 294 in FIG. 2. In other embodiments, the fracture can have a increasing or decreasing or variable height. In one embodiment as shown of fracture 231, a desired fracture can have a generally constant width. In other embodiments, the fracture can have a increasing or decreasing or variable width. In still other embodiments, the fracture can consist of multiple fractures that form a network.

Figure 2B:
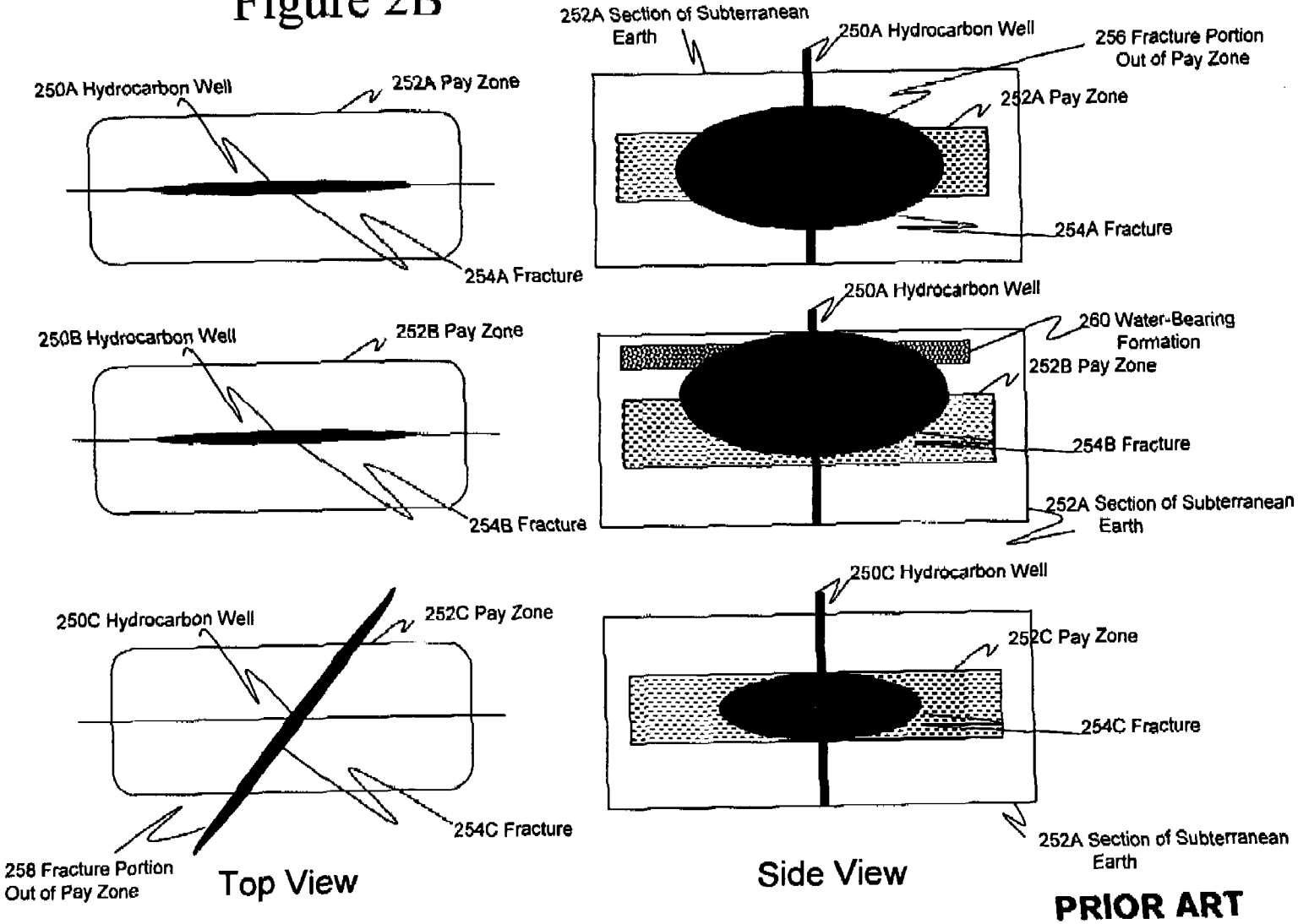
FIG. 2B shows embodiments of fractures consistent with the present innovations.

FIG. 2B shows top views and side views of embodiments of fractures that can be controlled or avoided using the methods and systems of the present innovations. In one embodiment, fracture 254A extends out of pay zone 252A along the vertical axis and can be considered undesirable because fracturing fluids are wasted. In one embodiment, fracture 254B undesirably extends vertically out of the pay zone 252B and into water bearing formation 260. In one embodiment fracture 254C forms in an unintended direction and out of the pay zone 252C but has a desirable vertical height. In one embodiment, the profile of fracture 254C can be considered undesirable.

Figure 2C:
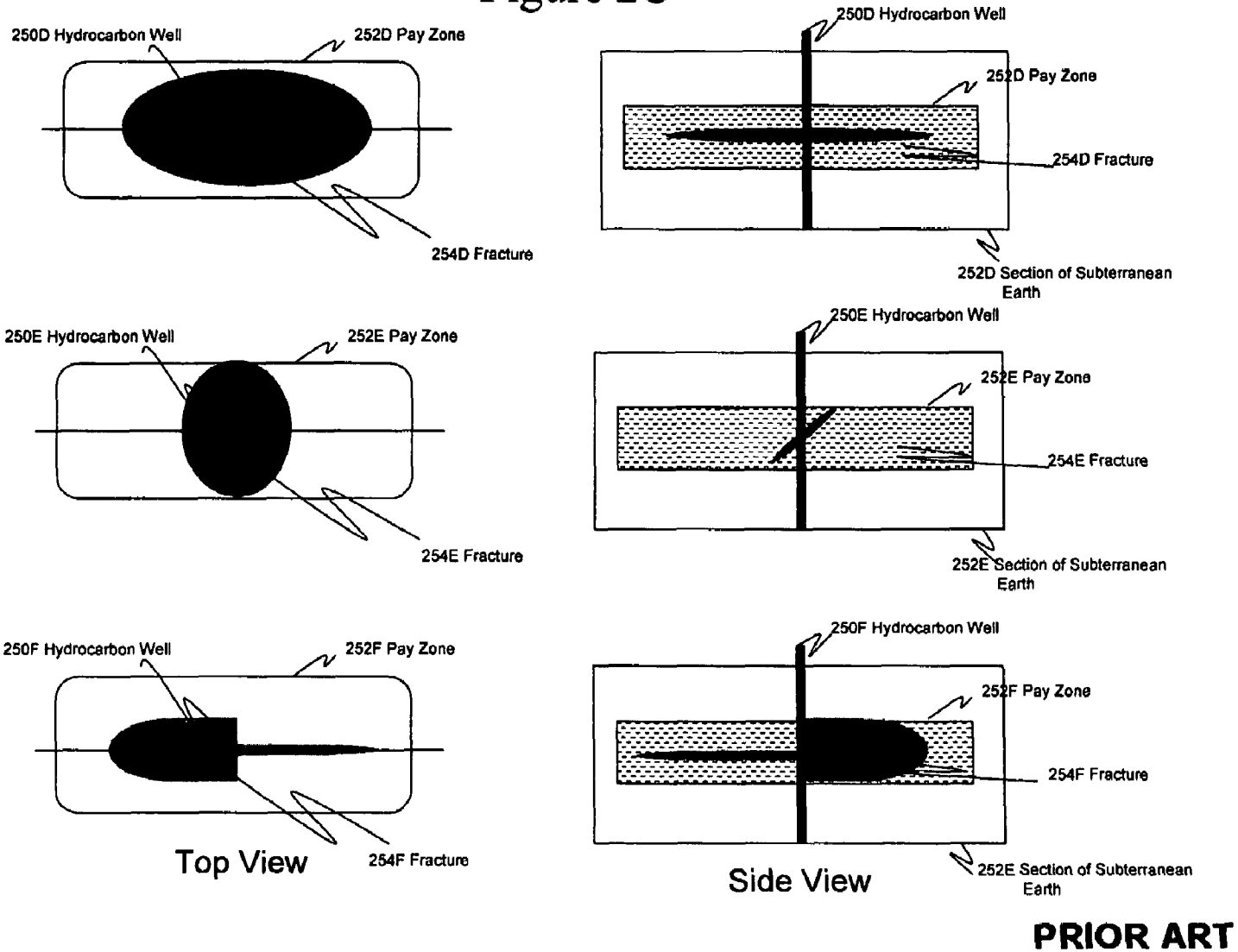
FIG. 2C shows embodiments of further fractures consistent with the present innovations.

FIG. 2C shows further embodiments of fractures that can be controlled or avoided using the methods and systems of the present innovations. Fracture 254D formed horizontally instead of vertically but is completely within the pay zone 252D. In one embodiment, fracture 254D can be undesirable. Fracture 254E formed in a horizontally-tilted direction but is completely within the pay zone 252E. In one embodiment, fracture 254E can be undesirable. Fracture 254F formed in such a manner as one half of the fracture is vertical and the other half is oriented horizontally. In one embodiment, but still completely within pay zone 252F. In one embodiment, fracture 254F can be undesirable.

Figure 2D:
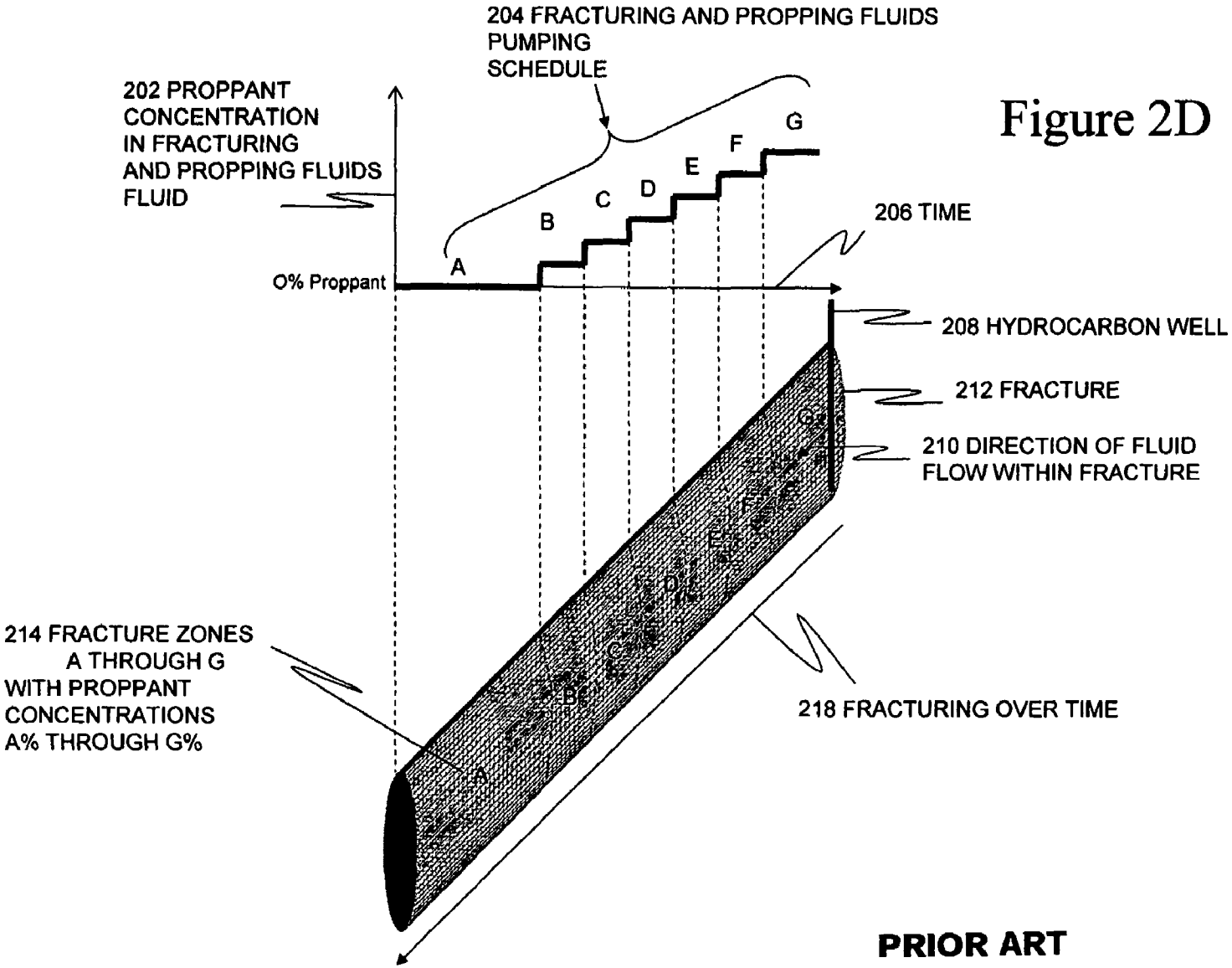
Figure 2D PRIOR ART
FIG. 2D shows an embodiment of proppant placement within a fracture consistent with the present innovations.

FIG. 2D shows one embodiment of a desired proppant placement profile at a particular point in time of a fracturing and proppant process, by way of example and not of limitation, of proppant profiles that can be controlled by the methods and systems of the present innovations. In this embodiment, a single type of proppant can be distributed in varying concentration within the fracturing fluid down the length of a fracture 212. In this embodiment, no leak-off is assumed whereby the liquid portion of the fracturing fluids flow into the formation being fractured.

Fracture 212 is shown extending from only one side of hydrocarbon well 208 for simplicity of illustration. Further, as fracturing and propping fluids are pumped down-hole, their direction of flow is shown as direction 210 within the fracture. For purposes of simple illustration, no other directions of flow are depicted, although many are possible. Additionally for purposes of simple illustration, the fracture is shown as constant height with no concentration gradient in the vertical dimension.

As greater volumes of fracturing and propping fluids are pumped, fracture 212 grows in length. Time axis 218 shows the propagation of fracture over time. Assuming pure plug flow (e.g. no back-mixing in the opposite direction to direction 210) of the fluids, fracture zone 214A is the newest fracture zone but contains the fluid first pumped into the fracture. Likewise, fracture zone 214G is the oldest zone but contains the latest fluid. Fracturing and propping fluids pumping schedule 204 shows the variation of proppant concentration 202 in the fracturing flow stream over the duration in pumping time 206 (corresponding to time axis 218) in which fracturing and propping fluids 202A through 202G are pumped into well 208. Schedule 204 assumes a constant pumping rate for simplicity of illustration. The schedule 204 and the fracture 218 are pictorially aligned such that their time axes are directionally opposite to each other. Thus, fracturing fluid 204A, which has zero proppant, is the first to be pumped and it fills fracture zone 214A, which is the last to be formed.

In one embodiment, the fracturing process depicted in FIG. 2B can be continued with a high degree of leak-off into the formation to the extent that virtually all of fracturing fluid 204A is leaked-off into the formation.

In one embodiment, the process can be continued in such a manner as to not only have all of fracturing fluid 204A leak-off into the formation, but that just the correct amounts of the liquid portions of each of fracturing fluids 204B through 204G leak-off into the surrounding formation such that at the moment all of fracturing fluid 204A has leaked-off, the concentration of the proppant across all fluids 204B though 204G are equal. Then, at the moment the concentration of the proppant can be constant across fluids and zones, the hydraulic pressure is released and fracturing is halted. Then, the fracture can close upon itself and the liquid portion of the fracturing fluids can leak-off into the formation until the proppant consolidates to a bed such that the packed proppant bed supports or props the fracture. Assuming the fracture is of uniform width, the fracture would be uniformly propped with a uniformly packed bed of proppant down the length of fracture 212.

Proppant placement profiles over time can incorporate different properties including variation of concentration of proppant in three dimensions in space, variation in the size, shape or chemical composition of the proppant, mechanical strength of the proppant, in composition of special ingredients in the propping fluids, in the time special ingredients have been mixed into the fluids, and in temperature of the fluid or fluids within the fracture.

Figure 2E:
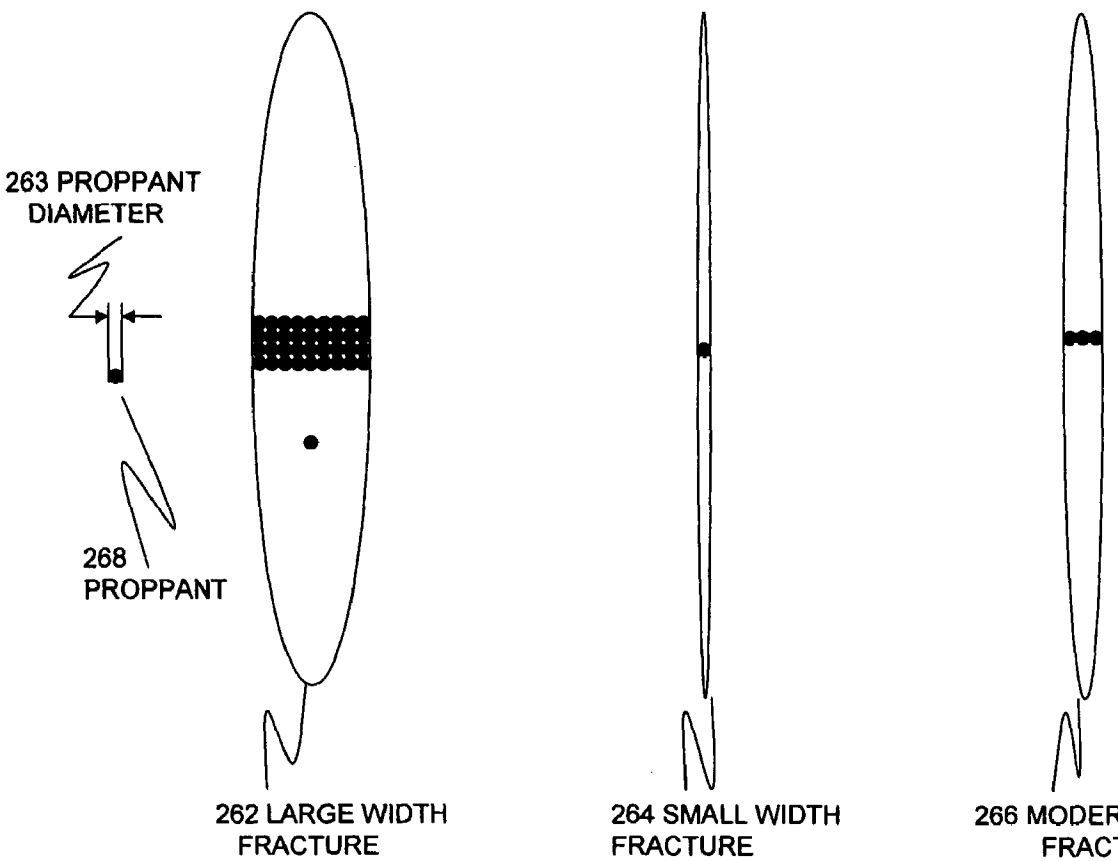
FIG. 2E shows embodiments of propped fracture widths consistent with the present innovations.

FIG. 2E shows embodiments of propped fracture widths that can be controlled or avoided with the methods and systems of the present innovations. A single grain of proppant 268, such as a grain of sand as can be used as a proppant, has a width 263. For simplicity of illustration, the width of all of the proppant particles is assumed constant. In a large fracture width 262 where the width of the fracture is significantly greater than the width of the proppant particles, the flow of a fracturing fluid containing proppant 268 can occur without the proppant collecting and causing a screen-out. In one embodiment, fracture 262 is desirable. In a small fracture width 264, the flow of a fracturing fluid containing proppant 268 is impeded because the proppant will collect and wedge in the small width fracture. In one embodiment, small width fracture 264 is undesirable. In a moderate width fracture 266, the flow of a fracturing fluid containing proppant 268 can occur within fracture 266 if the concentration of the proppant is low enough as to not collect to form screen-outs and the rheology of fluid is such that the proppant stays suspended and the fluid itself is not of an excessively high viscosity.

In one embodiment, the methods and systems of the present innovations can simultaneously control the width of the fracture, the concentration of the proppant in the fracturing fluid, and the rheology of the fracturing fluid such that the fracturing process can be continue to be conducted without reaching a maximum operating pressure of the fracturing system whereby the desired fracture dimensions are increased, resulting in higher levels of drainage area being exposed to a hydrocarbon well. In one embodiment of the present innovations, proppant concentration as well as proppant particle diameter and shape can also be planned to be modified during a pumping schedule such as schedule 24.

FIG. 3 shows a non-limiting embodiment of an exemplary subterranean hydrocarbon formation fracturing site 300 to which the methods and systems of the present innovations can be applied. Site 300 can be located on land or on or in a water environment. The embodiment will be described with reference to a land-based site.

The site can contain one or more proppant stores 303 which contain one or more different proppant types or grades as would be known to one skilled in the art of proppant specification and design. The site can contain one or more fluid storage systems 304 for water, solvents, non-aqueous fluids, pad fluids, pre-pad-fluids, viscous fluids for suspending proppants, and liquid components to tailor-make fracturing fluids as would be known to open skilled in the art of fracturing fluid specification and design. The site can contain one or more special solid or liquid ingredient stores 306 which have specialized functions in the fracturing and propping processes. The flow actuation and control of proppants, fluids, and special ingredients can be controlled by activators 308, 308A, and 308B, respectively. Blender or blenders 310 can receive the proppants, the fluids and special ingredients to prepare fracturing and propping fluids in various proportions. Pump or pumps 314 can pump the fracturing and propping fluids down-hole into hydrocarbon well 316 beneath the surface of the earth 334. Components 303, 304, 306, 308, 308A, 308B, 310, 313, 314, 335, and 342 comprise surface components 330. Sensors 313 can monitor the fracturing and propping fluid flow rates, as well as the properties of the fluids, at positions either before or after pumps 314, or at both locations. Down hole tools 318 can act directly on the fracturing and propping fluids to control the values of the properties of the fluids as the fluids create and enter fracture 333, which is shown, for simplicity of illustration, in one direction from well 316. Down hole fluid property sensors 324 can measure the fluid property values as the fluids enter fracture 333. In-fracture fluid sensors 328 can sense the fluid property values of the fluid inside the fracture. Down hole fracture sensors 326 can sense the dimensions of fracture 333 from a down hole location. Off-set fracture sensors 340 can sense the dimensions of fracture 333 from an off set location down hole in a different well 338. Surface fracture sensors 335 can sense the dimensions of fracture 333 from the surface of the Earth. Control system 342 can be linked via signal links 336 to the listing of components as detailed in FIG. 2. Control system 342 can also be linked to external system 344 which in one embodiment can be an external data collection or supervisory control system. Control system 342 can contain various embodiments of the innovative control methods of the present application, such as the method of FIG. 1. Control system 342 can contain a desired subterranean fracture profile consistent with the present application.

Figure 1:
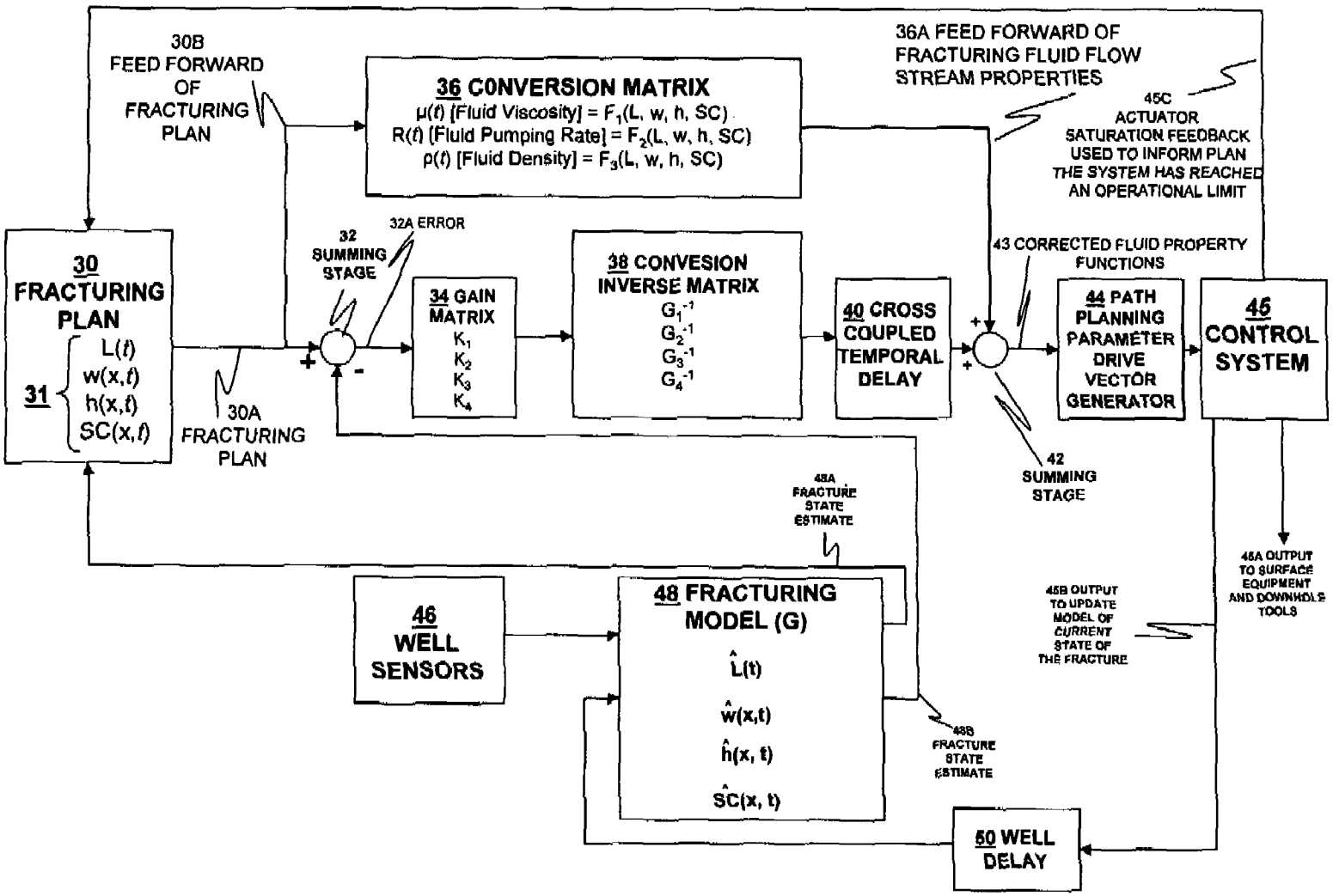
FIG. 1 shows a preferred embodiment of the present innovations for a method for conducting a fracturing process consistent with the present application.

FIG. 1 shows a preferred embodiment of the fracturing methods of the present innovations. The method of FIG. 1 can be employed to conduct fracturing on a site such as fracturing site 300. The method of FIG. 1 can be employed as part of control system 342 or external system 344 to conduct fracturing on site 300.

The method of FIG. 1 and system 300 can be used to conduct and control the fracturing and proppant process being used to create and prop fracture 333 within pay zone 334 in hydrocarbon well 316 using fracturing fluid flow stream 315. Fracturing plan 30 can be designed to achieve a particular increase in hydrocarbon production from an operating well as known to one skilled in the art of fracturing hydrocarbon production using techniques such as the mini-fracture test prior to actual fracturing, as described earlier. Fracturing plan 30 can also be designed for a newly created well to achieve a higher output upon start-up of the well had the fracturing operation not been conducted. Fracture profile matrix 31 can be outputted from fracturing plan stage 30 as fracturing plan 30A, where L(t) is the propagation function of the length dimension, L, over time, t, h(x,t) is the propagation function of the height dimension, h, over time and over the distance, x down the fracture length L, and w(x,t) is the propagation function of width dimension, w, over time and over x. SC(x,t) is the proppant placement function over time and over x. In one embodiment, the proppant placement function represents the concentration of the proppant at point x and time t. Conversion matrix 36 can use matrix 31 as a feed forward of the fracturing plan, as signal 30B, to determine a feed forward of the fracturing fluid flow stream properties such as flow rate, viscosity, and density, as signal 36A. Stage 36 can determine the fracturing fluid viscosity function $\mu(t)$, the fracturing fluid pumping flow rate function R(t), and fracturing fluid density function $\rho(t)$. The fracturing plan matrix 31 as signal 30A can be compared against the current fracture state estimate matrix 48B in summing stage 32. The error 32A of the actual state versus the planned state can then be used to provide a correction of the fracturing fluid flow stream properties to summing stage 42. To provide the correction, the output of stage 32 can be multiplied by a predetermined gain matrix 34 which can be processed through conversion inverse matrix 38. This stage this is the inverse of the fracturing model to convert the error correction input to a usable form (e.g. input viscosity, density, rate) for controlling the fracturing fluid flow stream properties. The inputs are derived by error correction vector [(L*−L)*k1, (W*−W)*k2, . . . ]*inverse(G). This decouples the cross couple of the states, so that L, w, h, and SC can be controlled independently. Depending on the hydrocarbon formation, this decoupling may or may not be possible, but this action at least minimizes the cross couple effects up to what is physically possible. and adjusted by cross coupled temporal delay stage 40. The delay is used to ensure all the inputs are driven at the same time context. For example, rate can be changed instantly, but viscosity is delayed by the pipe travel time due to the hold-up of the volume of the well. The output of stage 42 as corrected fluid property functions 43 can be used by stage 44 to generate drive vectors for the fracturing fluid making and supply system as surface components 330 in FIG. 3, as well as for down-hole tools 318, to be fed to control system 45. Control system 45 can then output signal 45A to control the surface and down-hole tools of the fracturing system, such as generally shown in site 300. The same information as signal 45B can then be used to update the current estimate of the state of the fracture and proppant placement therein. Signal 45B can be first conditioned using well delay stage 50 to adjust for the delay between when a fluid property such as density or viscosity is adjusted at the surface in the supply and making system and when such changes reach down-hole and begin to affect the mechanical fracturing process, if no down-hole tools are used to adjust those properties. If down-hole tools can be employed to adjust the properties, their use would effectively eliminate the need for the well delay stage 50. Additionally, changes in the fracturing fluid flow rate are essentially immediately effective down-hole and do not require adjustment by well delay 50.

Fracturing model 48 can be used not only to create an initial fracture plan, but to estimate the current state of the fracture during fracturing in real-time. This estimate can use fracture well sensors 46, such as exemplified as down-hole sensors 326 and/or off-set sensors 340 and/or surface sensors 335 in FIG. 3. Model 48 can also use mechanical fracturing models known to a person skilled in the art of fracturing, as either two-dimensional or three dimensional, as described earlier, to estimate the propagation (e.g. the dimensions, geometry, orientation, and directional positioning) of fractures through a formation of given mechanical properties in relation the pumped volume, pumping rate, and rheologic properties of the fracturing fluid being used. Model 48 can also modify itself by comparing actual results of measurements of well sensors 46 to predicted results of the mechanical fracturing models to correct for any inaccuracies.

Fracturing model 48 can generate an estimate of the current state of the fracture as signal 48B, where the signal 48B is used to determine the error in current state from planned state in summing stage 32 as described earlier. Model 48 can also supply the same information as signal 48A to allow fracturing plan 30 to be updated to a new fracture plan using an adaptive system within stage 30.

Signal 45 as actuator saturation feedback can be used to inform the fracturing plan 30 that the system has reached an operational limit.

In one embodiment, down hole fluid sensors can utilize the systems and methods of U.S. Pat. No. 6,978,831B2, to Phillip D. Nguyen, entitled "System and Method for Sensing Data in a Well During Fracturing", granted Dec. 27, 2005, which is hereby incorporated by reference.

In one embodiment, down hole viscosity can be adjusted using the methods of U.S. Pat. Nos. 6,719,055 and/or 6,959,773, both to Ali Mese and Mohamed Soliman, both entitled "Method for Drilling and Completing Boreholes with Electro-Rheological Fluids," granted Apr. 13, 2004 and Nov. 1, 2005, respectively, which are hereby incorporated by reference.

In one embodiment, down hole tools 318 can utilize the teaching, tools, and/or methods of U.S. Pat. No. 6,938,690, to Jim B. Surjaatmadja, entitled "Downhole Tool and Method for Fracturing a Subterranean Well Formation", granted Sep. 6, 2005, which is hereby incorporated by reference.

In one embodiment fracturing plan 30A is a time series of desired geometric parameters, locations, and dimensions of fracture 333 over the time the fracturing process is conducted, and the concentration and distribution of proppant within the fracture.

In one embodiment, fracturing plan 30A is determined from a desired performance target for the fracturing operation where the target is a particular increase in production. Further to this embodiment, stage 30 uses the current fracture estimate 48A to predict a resulting fracture profile based on the progress and trends of the current fracture propagation and proppant placement. Further, a resulting hydrocarbon production performance increase of the finished and propped fracture is determined. The resulting performance increase is compared to the targeted performance increase. If the error is above a predetermined value, an adaptive model within stage 30 then adjusts the desired fracture profile over the remaining time for the process to better achieve the desired fracture performance increase.

In one embodiment, well sensors 46 comprise tilt-meter measurements as known to one skilled in the art of seismic movement and displacement. In still another embodiment, the sensing measurements comprise micro-seismic event monitoring measurements as also known to such a skilled person.

According to a disclosed class of innovative embodiments, there is provided a method for performing fracturing on a well, comprising the actions of (a) fracturing, in accordance with a fracturing model and a fracturing plan, while monitoring inputs used to estimate fracturing progress; (b) automatically modifying said fracturing model from time to time, as said monitoring action indicates that said fracturing model may be inaccurate; and (c) automatically modifying said fracturing plan, in dependence on said action (b).

According to a disclosed class of innovative embodiments, there is provided a subterranean fracturing process system for a hydrocarbon well, comprising at least one pump for delivering a fracturing fluid flow stream into a hydrocarbon well, surface and/or down-hole actuators which jointly control the down-hole-values of one or more properties of said flow stream, and a control system which controls said actuators and said pump in relation to a subterranean fracturing plan using a fracturing model, to govern said down-hole values, wherein said control system further automatically modifies said fracturing model from time to time, when at least one monitoring action indicates that said fracturing model may be inaccurate; and wherein said control system automatically modifies said fracturing plan to optimize the results of the fracturing process.

Modifications and Variations

As will be recognized by those skilled in the art, the innovative concepts described in the present application can be modified and varied over a range of applications, and accordingly the scope of patented subject matter is not limited by any of the specific exemplary teachings given. It is intended to embrace all such alternatives, modifications, and variations that fall within the spirit and broad scope of the appended claims.

The methods and systems of the present application can operate across a wide range of subterranean hydrocarbon formation fracturing and propping situations and conditions. One of ordinary skill in the art, with the benefit of this disclosure, will recognize the appropriate use of the methods and systems for a chosen application of a given or dynamic set of operating parameters.

Optionally, the methods and systems of the present application can be configured or combined in various schemes. The combination or configuration depends partially on the required fracturing process control precision and accuracy and the operational envelope of the fracturing process. One of ordinary skill in the art of subterranean hydrocarbon formation fracturing, with the benefit of this disclosure, will recognize the appropriate combination or configuration for a chosen application.

Optionally, flags such as a particular process variable out of range which may define the reliability of the data or provide variables to use for process control. One of ordinary skill in the art, with the benefit of this disclosure, will recognize the appropriate additional measurements that would be beneficial for a chosen application.

Optionally, such measurements taken by the methods and systems of the present application may also be sent to the external system 344 of FIG. 3 for further processing or use. For example, if down-hole pressure exceeds a target by a certain amount, this fact could be used to re-tune process controllers, e.g. pump speed controllers. Or, for example, fluid viscosity having a large standard deviation beyond a preset level might be used for the same flagging determination to re-tune viscosity controllers.

Optionally, rheologic property temperature compensation can be employed used to adjust for shifts in temperature using reference data sets relating temperature change to total fluid viscosity change, or curves fitted to such reference data.

Optionally, because the viscosity changes of different fluid compositions or recipes can vary from application to application, or across different embodiments, different reference data sets or curves or hydraulic fracturing models fitted to such data sets may be employed, maintained, or stored in control system 342 or external system 344. One of ordinary skill in the art, with the benefit of this disclosure, will recognize the appropriate systems to employ for such viscosity compensation methods.

Optionally, the methods of the present application can also be embodied in a set of instructions that can be used on a general purpose desktop or laptop computer or microprocessor system, or external system 344 in addition to being embodied in control system 342. The set of instructions can comprise input instructions that receives data or models from external system 344. Similarly, the input instructions can accept instructions from a user via one or more input devices, such as a keyboard, mouse, touchpad, or other input device. The instructions can cause the computer or microprocessor system to display information, such as the results of the methods of the present innovations, to a user, through a display monitor, printer, generated electronic file, or other such device. The instructions can also cause the computer or microprocessor system to transmit the results to a distant user via modem, cable, satellite, cell link, or other such means. For such digital communications, RS-422 or RS-485 can optionally be used to allow links control system 342 or external system 344 to multiple external units. Optionally, a 4-20 milliamp analog output signal can be used to allow external processing of the system measurements.

Optionally, the methods of the present invention can also be embodied in a computer readable medium.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle. The claims as filed are intended to be as comprehensive as possible, and NO subject matter is intentionally relinquished, dedicated, or abandoned.

The invention claimed is:

1. A method for performing fracturing on a well, comprising the actions of:

(a) fracturing, in accordance with a fracturing model and a fracturing plan, while monitoring inputs used to estimate fracturing progress;

(b) automatically modifying said fracturing model from time to time, as said monitoring action indicates that said fracturing model may be inaccurate; and (c) automatically modifying said fracturing plan, in dependence on said action (b).

2. The method of claim 1 wherein said fracturing plan is a time series of desired results for a subterranean fracturing process for a hydrocarbon well comprising:

(i) target three-dimensional spatial coordinates defining the boundaries and interior space of a subterranean fracture, and (ii) the target volume of said fracture occupied by a proppant at said spatial coordinates.

3. The method of claim 1 wherein said fracturing plan is a time-based description of desired results for a subterranean fracturing process for a hydrocarbon well comprising:

(i) the target propagation direction of a fracture from said well;

(ii) at least two spatial dimensions defining the target geometry of said fracture as it propagates; and (iii) the target volume fraction of said fracture occupied by a proppant for at least some locations within said fracture as it propagates.

4. The method of claim 2 wherein said fracturing plan is further comprised of:

(iii) target volume of said fracturing fluid pumped into said fracture; and (iv) the target pressure of said fluid at least at some spatial coordinates within said fracture and/or said well.

5. The method of claim 3 wherein said fracturing plan is further comprised of:

(iv) target volume of said fracturing fluid pumped into said fracture; and (v) the target pressure of said fracturing fluid at some locations within said fracture and/or said well.

6. The method of claim 1 wherein said model comprises:

(i) three-dimensional spatial coordinates defining the boundaries and interior space of the current state of a subterranean fracture, and (ii) the volume of said fracture currently occupied by a proppant at said spatial coordinates.

7. The method of claim 1 wherein said model comprises:

(i) the current propagation direction of a subterranean fracture from a hydrocarbon well under-going a fracturing process;

(ii) at least two spatial dimensions defining the current status of said fracture; and (iii) the volume fraction of said fracture currently occupied by a proppant for at least some locations within said fracture as it propagates.

8. The method of claim 6 wherein said model is further comprised of:

(iii) actual volume of said fracturing fluid pumped into said fracture; and (iv) actual pressure of said fluid at least at some locations within said fracture.

9. The method of claim 7 wherein said model is further comprised of:

(iv) actual volume of said fracturing fluid pumped into said fracture; and (v) actual pressure of said fluid at least at some locations within said fracture.

10. The method of claim 1 wherein said model receives sensed measurements of the status of the fracture dimensions from surface, down-hole, and/or off-set sensors.

11. The method of claim 1 wherein the properties of the fracturing fluid flow stream being used to conduct said fracturing are selected from the group consisting of volumetric flow rate, mass flow rate, temperature, pressure, viscosity, pH, percent proppant in the fluid, concentration of at least one chemical that modifies the rheologic properties of said fracturing fluid, and the concentration of a least one chemical that modifies the pH of said fracturing fluid, or combinations thereof.

12. The method of claim 1 wherein target down-hole properties of the fracturing fluid flow stream being used to conduct said fracturing comprises at least one transform that calculates real-time values for said properties by summing:

(i) calculated values for each of said properties using a model of fracture propagation to achieve current said plan; and (ii) calculated adjustments for each of said properties based on the error between said plan and said current state of the fracture.

13. A subterranean fracturing process system for a hydrocarbon well, comprising:

at least one pump for delivering a fracturing fluid flow stream into a hydrocarbon well;

surface and/or down-hole actuators which jointly control the down-hole-values of one or more properties of said flow stream; and a control system which controls said actuators and said pump in relation to a subterranean fracturing plan using a fracturing model, to govern said down-hole values;

wherein said control system further automatically modifies said fracturing model from time to time, when at least one monitoring action indicates that said fracturing model may be inaccurate; and wherein said control system automatically modifies said fracturing plan to optimize the results of the fracturing process; and wherein said fracturing plan is a time series of desired results for operating said subterranean fracturing process system comprising:

(i) the target three-dimensional spatial coordinates defining the boundaries and interior space of a fracture, and (ii) the target volume of said fracture occupied by a proppant at said spatial coordinates.

14. The system of claim 13 wherein said desired fracturing plan is further comprised of:

(iii) target volume of said fracturing fluid pumped into said fracture; and (iv) the target pressure of said fluid at least at some spatial coordinates within said fracture.

15. A subterranean fracturing process system for a hydrocarbon well, comprising:

at least one pump for delivering a fracturing fluid flow stream into a hydrocarbon well;

surface and/or down-hole actuators which jointly control the down-hole-values of one or more properties of said flow stream; and a control system which controls said actuators and said pump in relation to a subterranean fracturing plan using a fracturing model, to govern said down-hole values;

wherein said control system further automatically modifies said fracturing model from time to time, when at least one monitoring action indicates that said fracturing model may be inaccurate; and wherein said control system automatically modifies said fracturing plan to optimize the results of the fracturing process; and wherein said fracturing plan is a time-based description of desired results for operating said subterranean fracturing process system comprising:

(i) the target propagation direction of a fracture from said well;

(ii) at least two spatial dimensions defining the target geometry of said fracture as it propagates; and (iii) the target volume fraction of said fracture occupied by a proppant for at least some locations within said fracture as it propagates.

16. The system of claim 15 wherein said desired fracturing plan is further comprised of:

(iv) target volume of fracturing fluid pumped into said fracture; and (v) the target pressure of said fracturing fluid at some locations within said fracture.

17. A subterranean fracturing process system for a hydrocarbon well, comprising:

at least one pump for delivering a fracturing fluid flow stream into a hydrocarbon well;

surface and/or down-hole actuators which jointly control the down-hole-values of one or more properties of said flow stream; and a control system which controls said actuators and said pump in relation to a subterranean fracturing plan using a fracturing model, to govern said down-hole values;

wherein said control system further automatically modifies said fracturing model from time to time, when at least one monitoring action indicates that said fracturing model may be inaccurate; and wherein said control system automatically modifies said fracturing plan to optimize the results of the fracturing process; and wherein said properties of said fracturing fluid flow stream are selected from the group consisting of volumetric flow rate, mass flow rate, temperature, pressure, viscosity, pH, percent proppant in the fluid, concentration of at least one chemical that modifies the rheologic properties of said fracturing fluid, and the concentration of a least one chemical that modifies the pH of said fracturing fluid, or various combinations thereof.

18. A subterranean fracturing process system for a hydrocarbon well, comprising:

at least one pump for delivering a fracturing fluid flow stream into a hydrocarbon well;

surface and/or down-hole actuators which jointly control the down-hole-values of one or more properties of said flow stream; and a control system which controls said actuators and said pump in relation to a subterranean fracturing plan using a fracturing model, to govern said down-hole values;

wherein said control system further automatically modifies said fracturing model from time to time, when at least one monitoring action indicates that said fracturing model may be inaccurate; and wherein said control system automatically modifies said fracturing plan to optimize the results of the fracturing process; and wherein said control system determines target down-hole properties of said fracturing fluid flow stream by using at least one transform that sums:

(i) calculated values for each of said properties using a model of fracture propagation to achieve current said plan; and (ii) calculated adjustments for each of said properties based on the error between said plan and said current state of the fracture.

* * * * *